US005425411A

United States Patent [19]

Kami

[11] Patent Number: 5,425,411

[45] Date of Patent: Jun. 20, 1995

[54] METHOD FOR COOLING PLUNGER TIP OF DIE-CASTING MACHINE

[75] Inventor: Shigetake Kami, Tokyo, Japan

[73] Assignee: Ryobi Ltd., Hiroshima, Japan

[21] Appl. No.: 174,027

[22] Filed: Dec. 28, 1993

[30] Foreign Application Priority Data

Dec. 28, 1992 [JP] Japan ..... 4-360591

[51] Int. Cl.[6] ..... B22D 17/10; B22D 17/32

[52] U.S. Cl. ..... 164/457; 164/151; 164/155.3; 164/113; 164/312

[58] Field of Search ..... 164/457, 151, 155.3, 164/154.8, 113, 312, 458

[56] References Cited

U.S. PATENT DOCUMENTS 4,583,579 4/1986 Miki et al. ..... 164/457

*Primary Examiner*—Kuang Y. Lin

*Attorney, Agent, or Firm*—Sughrue, Mion, Zinn, Macpeak & Seas

[57] ABSTRACT

A method for cooling a plunger tip of a die-casting machine for maintaining a proper clearance between a plunger tip and a shot sleeve. A proper hydraulic pressure in an injection cylinder is determined at which no galling occurs in the shot sleeve. Hydraulic pressure in the injection cylinder is measured several times in a state where no molten metal exists in the shot sleeve. For example, measured is the hydraulic pressure in the injection cylinder at the time of return stroke of the plunger tip immediately after injecting operation. Average hydraulic pressure is computed based on the plurality of measured hydraulic pressure. The average hydraulic pressure is compared with the proper hydraulic pressure. If the former is greater than the latter, clearance between the plunger tip and the shot sleeve is deemed to be too small. Thus, supply amount of cooling liquid to the plunger tip is increased to reduce a diameter of the plunger tip.

7 Claims, 1 Drawing Sheet

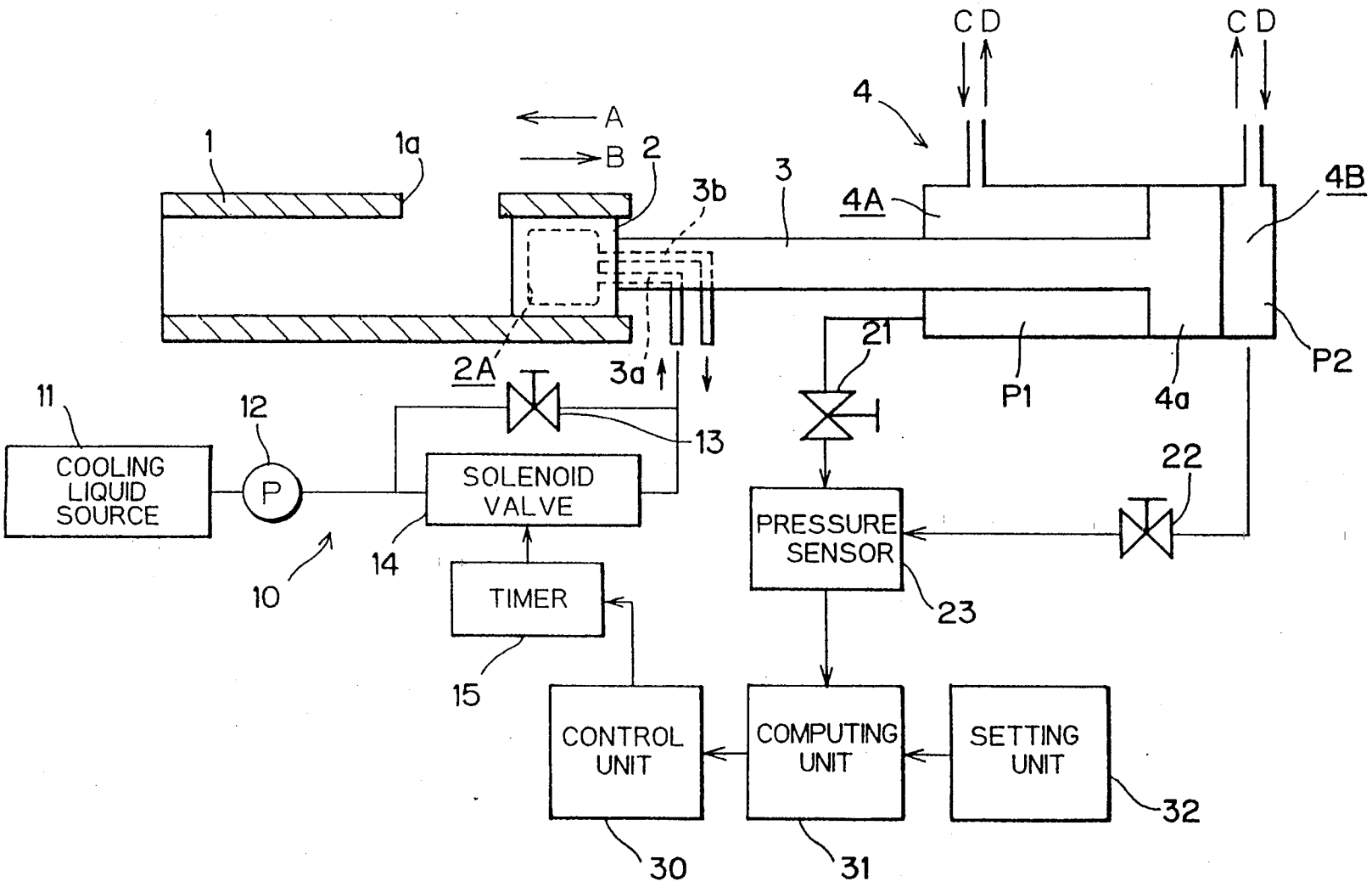
4B
P2
C D
C D
4a
22
32
SETTING UNIT
P1
23
4
4A
21
PRESSURE SENSOR
COMPUTING UNIT
31
3
3b
13
2
3a
A
B
SOLENOID VALVE
TIMER
CONTROL UNIT
30
2A
15
1a
14
10
12
P
1
COOLING LIQUID SOURCE
11

METHOD FOR COOLING PLUNGER TIP OF DIE-CASTING MACHINE

BACKGROUND OF THE INVENTION

The present invention relates to a method for cooling a plunger tip of a die-casting machine, and more particularly to such method capable of controlling sliding resistance of the plunger tip relative to a shot sleeve.

A die-casting machine has a shot sleeve having a pouring port and a plunger tip slidably disposed in the shot sleeve. The plunger tip is connected to a plunger rod connected to an injection cylinder. The molten metal is poured into the shot sleeve through the pouring port, and the molten metal is introduced into a mold cavity by a reciprocal motion of the plunger tip. In this case, proper sliding resistance is required between an inner peripheral surface of the shot sleeve and an outer peripheral surface of the plunger tip. If large clearance therebetween is provided, the molten metal may be entered into the clearance and solidified thereat, which may cause local galling. This galling at the sliding portion may lower service life of the injection components, and degrade a casted product. Further, if the clearance is too large, the molten metal may be flowed toward a plunger rod, in other words, back flush may occur.

Thus, proper sliding resistance is required for avoiding the galling and the back flush. On the other hand, if excessive sliding resistance is provided, the plunger tip cannot be smoothly reciprocated in the shot sleeve. Accordingly, the clearance between the plunger tip and the shot sleeve must be maintained in an optimum level.

According to one conventional technique, cooling liquid such as water is circulated into the plunger tip having high temperature due to contact with the high temperature molten metal. In an attempt to obtain desired sliding resistance, thermal expansion of the plunger tip is controlled by the control to the cooling liquid supply rate to the plunger tip. However, this control is made by controlling liquid supply valve opening degree on a basis of an operator's skilled judgment on the condition of the die-casting machine.

This control method is fully dependent on the operator's skill and experience. Therefore, the clearance at the sliding portion cannot be properly maintained, if the shot sleeve is made of a special material, such as ceramics and cermet, those having thermal expansion coefficient different from that of the material of the plunger tip, or if the shot sleeve is heated. Consequently, galling or other problems still remain unsolved.

Further, in a recent demand, improvement on maintaining elevated temperature of the molten metal is required. For this, is used water soluble lubricating agent containing solid lubricant. In case of the employment of such lubricating agent, galling may occur due to shortage of fats and oils components and deposition of the solid lubricants in the shot sleeve. Therefore, it would be difficult to maintain proper clearance at the sliding portion.

SUMMARY OF THE INVENTION

It is therefore, an object of the present invention to provide a method for cooling a plunger tip of a die-casting machine, the method being capable of providing optimum sliding resistance by proper control to clearance between a shot sleeve and the plunger tip irrespective of the materials of the shot sleeve and the plunger tip, and regardless of the frictional-wearing condition.

The present inventor found that directly setting quantitative resistance level as a proper sliding resistance is difficult. To be more specific, even if there is provided large clearance between the shot sleeve and the plunger tip, the sliding resistance is also dependent on materials and temperatures of the sleeve and the plunger. Further, in an actual injection molding, molten metal may be easily entered into the clearance if the clearance is large. In this case, if the entered molten metal is solidified at this portion, then, the sliding resistance is increased, which in turn provide reverse conclusion that there is a small clearance between the plunger and the sleeve despite the fact that large clearance is actually provided therebetween.

With this point in mind, the present invention provides a method for cooling a plunger tip of a die-casting machine, the plunger tip being slidably and reciprocally movable in a shot sleeve and being driven by an injection cylinder for introducing a molten metal into a die, the method comprising the steps of provisionally setting a proper hydraulic pressure in the injection cylinder, measuring, a plurality of times, hydraulic pressures of the injection cylinder when the plunger tip is operated, while no molten metal exists in the shot sleeve, computing an average hydraulic pressure on a basis of the measured hydraulic pressures, and controlling supply amount of a cooling liquid to the plunger tip for controlling a clearance between the plunger tip and the shot sleeve by increasing the supply amount for a predetermined period of time if the average hydraulic pressure is greater than the proper hydraulic pressure.

In accordance with the plunger tip cooling method of this invention, hydraulic pressure is exerted on the injection cylinder for moving the plunger tip frontwardly. In this case, if galling occurs, the hydraulic pressure exhibit fluctuation which is outside of an ordinary variation in the hydraulic pressure attendant to the forward movement of the plunger tip. If no fluctuation is recognized, sliding resistance between the plunger tip and the shot sleeve is deemed to be proper. Accordingly, this pressure level at the time of return stroke or forward stroke of the plunger tip is stored as the proper hydraulic pressure. Alternatively, preinjection molding is conducted, and if a casted product does not have any deficiency, the hydraulic pressure in the return stroke or forward stroke of the plunger tip is stored as the proper hydraulic pressure.

Then, hydraulic pressure in the return stroke of the plunger tip is measured several times. Alternatively, hydraulic pressure in the forward stroke of the plunger tip, which is a rehearsal operation, is measured several times. Then average pressure of the measured pressure is computed. If high sliding resistance is provided, movement of the plunger tip is restrained. However, since the hydraulic pressure is continuously applied to the injection cylinder, the hydraulic pressure will be increased. Thus, the increased pressure may become greater than the proper hydraulic pressure.

In this case, cooling to the plunger tip must be promoted to reduce a diameter thereof, thereby increasing clearance between the plunger tip and the shot sleeve. Thus, as a result of the comparison between the average pressure and the proper hydraulic pressure, cooling liquid supply amount to the plunger tip is increased for a predetermined period of time to reduce the diameter of the tip, to thus maintain a desired sliding resistance.

BRIEF DESCRIPTION OF THE DRAWINGS

In the drawings;

Single FIG. 1 is a schematic view showing a cooling system for embodying a method for cooling a plunger tip in a die-casting machine according to one embodiment of the present invention.

DETAILED DESCRIPTION OF THE PREFERRED EMBODIMENT

A cooling system for embodying a method for cooling a plunger tip in a die-casting machine according to one embodiment of the present invention will be described with reference to FIG. 1.

In the single FIGURE, a shot sleeve 1 connected to a runner portion (not shown) of a die (not shown) has a pouring port 1*a*, through which a molten metal is supplied into the shot sleeve 1. A plunger tip 2 is reciprocally disposed in the shot sleeve 1. The plunger tip 2 is movable in a frontward direction indicated by an arrow A for injecting the molten metal into the die, and in a rearward direction indicated by an arrow B. The plunger tip 2 is driven by an injection cylinder 4 through a plunger rod 3. In the injection cylinder 4, a piston 4*a* connected to the plunger rod 3 is reciprocally movably provided, and the piston 4*a* divides an interior of the injection cylinder 4 into a front chamber 4A and a rear chamber 4B.

The plunger tip 2 has a cooling liquid chamber 2A, which is in communication with a cooling liquid intake passage 3*a* and a cooling liquid outlet passage 3*b* those formed in the plunger rod 3. The cooling liquid intake passage 3*a* is connected to a cooling liquid supply unit 10.

The cooling liquid supply unit 10 includes a cooling liquid source 11, a pump 12 connected thereto, and a valve 13, whose degree of opening is controllable at all times for circulating the cooling liquid such as water into the plunger tip 2. A second valve such as a solenoid valve 14 is disposed in parallel with the first valve 13. By opening the second valve 14, the cooling liquid supplying amount to the plunger 2 can be increased. The second valve 14 is connected to a control unit 30 (described later) through a timer 15.

The front and rear chambers 4A and 4B of the injection cylinder 4 are respectively connected to a hydraulic source (not shown) through a change-over valve (not shown). That is, for the forward motion of the plunger tip 2 in the direction A, hydraulic pressure is applied to the rear chamber 4B and hydraulic pressure in the front chamber 4A is released as shown in a direction indicated by an arrow D to move the piston 4*a* in the direction A. On the other hand, for the rearward motion of the plunger tip 2 in the direction B, hydraulic pressure is applied to the front chamber 4A while hydraulic pressure in the rear chamber 4B is released as shown in a direction indicated by an arrow C to move the piston 4*a* in the direction B.

In order to measure the hydraulic pressure applied to the front and rear chambers 4A and 4B, these chambers are connected to a pressure sensor 23 through valves 21 and 22. The pressure sensor 23 is connected to a computing unit 31 which is connected to a setting unit 32 and the control unit 30. The setting unit 32 is adapted to set therein a suitable pressure which is indicative of a proper sliding resistance between the plunger tip 2 and the shot sleeve 1. The computing unit 31 is adapted to receive hydraulic pressures in the front or rear chamber 4A or 4B, the pressure levels being measured in several times by the pressure sensor 23. The computing unit 31 is also adapted to compute average or mean hydraulic pressure based on the measured pressure levels, and compare the average pressure with the suitable pressure preset in the setting unit 32. The control unit 30 is adapted to transmit valve opening signal for opening the second valve 14 for a predetermined period preset by the timer 15 in accordance with a result of the comparison in the computing unit 31.

According to the first embodiment of this invention, a hydraulic pressure P1 in the front chamber 4A is measured by the pressure sensor 23 during return stroke or rearward motion of the plunger tip 2. To this effect, a hydraulic pressure in the front chamber 4A at the time of return stroke of the plunger 2 is set as a suitable pressure in the setting unit 32. For determining the suitable pressure level, pressure variation in the rear chamber 4B during the forward motion of the plunger 2 is examined in pre-injection or advance-injection. If no fluctuation other than ordinary variation attendant to the movement of the plunger tip 2 is detected, the determination falls that no galling occurs, and the hydraulic pressure in the front chamber 4A during the rearward motion of the plunger 2 is determined as the suitable pressure level, and the pressure level is set in the setting unit 32.

Then, injection is performed for casting a product. In this case, pressure level in the front chamber 4A is measured several times by the pressure sensor 23 during rearward motion of the plunger 2. Of course, in the return stroke of the plunger tip 2, no molten metal exists in the shot sleeve 1. In this injection, if galling occurs, the plunger tip 2 is imparted with a greater sliding resistance, so that the movement of the piston 4*a* in the B direction is restrained. However, since the hydraulic fluid is continuously supplied into the front chamber 4A for moving the plunger 2 in the direction B, hydraulic pressure in the front chamber 4A will be increased. This increased hydraulic pressure is measured several times during the return motion of the plunger 2, and the measured values P1 are successively transmitted to the computing unit 31.

In the computing unit 31, an average value of the measured values is computed, and the average value is compared with the suitable pressure. If the average value is greater than the suitable level, determination is made that the clearance between the shot sleeve 1 and the plunger tip 2 is smaller than a proper clearance. As a result of the comparison in the computing unit 31, the control unit 30 transmits valve opening signal to the second valve 14 for a predetermined period preset by the timer 15. Accordingly, cooling liquid supply amount to the plunger tip 2 is increased, so that the plunger 2 is further cooled for promoting its contraction in its diametrical direction. Thus, the clearance can be increased to reduce sliding resistance.

A cooling system for cooling a plunger tip in a die-casting machine according to a second embodiment of the present invention will next be described. According to the second embodiment, hydraulic pressure P2 in the rear chamber 4B is measured by the pressure sensor 23 when the plunger tip 2 is moved forwardly. To this effect, a hydraulic pressure in the rear chamber 4B at the time of forward stroke of the plunger 2 is set as a suitable pressure in the setting unit 32. For determining the suitable pressure level, pressure fluctuation in the rear chamber 4B during the forward motion of the plunger 2 is examined in preinjection or advance-injection. If no variation is detected, the determination falls that no galling occurs, and the hydraulic pressure in the rear chamber 4B is determined as the suitable pressure level, and the level is set in the setting unit 32.

Then, during coating of lubricant on parting faces of the dies, pressure level P2 in the rear chamber 4B is measured several times by the pressure sensor 23 during the forward motion of the plunger 2 and after the closure of the pouring port 1*a* by the plunger 2. In this injection, if galling occurs, the plunger tip 2 is imparted with a greater sliding resistance, so that the movement of the piston 4a in the A direction is restrained. However, since the hydraulic fluid is continuously supplied into the rear chamber 4B for moving the plunger 2 in the direction A, hydraulic pressure P2 in the rear chamber 4B will be increased. This increased hydraulic pressure is measured several times during the forward motion of the plunger 2, and the measured values P2 are successively transmitted to the computing unit 31 similar to the first embodiment.

If the average value of the values P2 is greater than the suitable pressure, determination is made that the clearance between the shot sleeve 1 and the plunger tip 2 is smaller than a proper clearance. Then, the second valve 14 is opened for increasing the cooling liquid supply amount to the plunger tip 2. Upon elapse of the predetermined time period, the second valve 14 is closed.

As described above, in the method for cooling the plunger tip of the die-casting machine, hydraulic pressure which is indicative of the sliding resistance is measured in a condition where no molten metal penetration occurs, i.e., the hydraulic pressure is measured under the condition where the plunger tip is moved while no molten metal is provided in the shot sleeve. By this measurement, size of the clearance between the plunger tip and the shot sleeve is judged. As a result of the judgment, cooling liquid supply amount to the plunger tip is controlled for maintaining optimum clearance. These process are repeatedly performed with respect to each shot to maintain the clearance.

Thus, according to the present invention, suitable clearance at the sliding portion can be maintained in each shot without relying on operator's skill and experience and irrespective of the materials of the shot sleeve and the plunger tip and regardless of the employment of the lubricant. Accordingly, prolonged service life of the shot sleeve and the plunger tip result. Since no galling occurs, quality of the casted product can be enhanced, and lubricant consumption can be reduced.

While the invention has been described in detail and with reference to the specific embodiment thereof, it would be apparent to those skilled in the art that various changes and modifications may be made therein without departing from the spirit and scope of the invention. For example, in the illustrated embodiments, the suitable pressure level is determined in light of fluctuation in hydraulic pressures. Instead of this determination, quality of the pre-injected product is examined, and if the product has no particular deficiencies at a hydraulic pressure in the front or rear chamber, this hydraulic pressure can be determined as the suitable pressure level.

What is claimed is:

1. A method for cooling a plunger tip of a die-casting machine, the plunger tip being slidably and reciprocally movable in a shot sleeve and being driven by an injection cylinder for introducing a molten metal into a die, the method comprising the steps of:

provisionally executing an injection for measuring a hydraulic pressure in the injection cylinder, and setting the provisional hydraulic pressure as a proper hydraulic pressure;

measuring, a plurality of times, hydraulic pressures of the injection cylinder when the plunger tip is operated, while no molten metal exists in the shot sleeve;

computing an average hydraulic pressure on the basis of the measured hydraulic pressures; and controlling supply amount of a cooling liquid to the plunger tip for controlling a clearance between the plunger tip and the shot sleeve by increasing the supply amount for a predetermined period of time if the average hydraulic pressures is greater than the proper hydraulic pressure.

2. The method as claimed in claim 1, wherein the controlling step comprises the steps of:

transmitting, to cooling liquid supply means, a signal indicative of increasing supply amount of the cooling liquid to the plunger tip; and supplying the cooling liquid to the plunger tip in response to the signal.

3. The method as claimed in claim 2, wherein the proper hydraulic pressure is determined by the steps of:

monitoring hydraulic pressure in the injection cylinder when no molten metal exits in the shot sleeve and during movement of the plunger tip; and determining the monitored hydraulic pressure as the proper hydraulic pressure if the monitored hydraulic pressure does not contain any fluctuation which is outside of an ordinary variation of hydraulic pressure attendant to the movement of the plunger tip.

4. The method as claimed in claim 3, wherein the injection cylinder has a front chamber and a rear chamber, the plunger tip is moved forwardly by applying the hydraulic pressure into the rear chamber, and the plunger tip is moved rearwardly by applying the hydraulic pressure into the front chamber;

5. The method as claimed in claim 4, wherein hydraulic pressure in the front chamber is measured for determining the proper hydraulic pressure and for measuring the plurality of times the hydraulic pressures during the rearward movement of the plunger tip.

6. The method as claimed in claim 4, wherein hydraulic pressure in the rear chamber is measured for determining the proper hydraulic pressure and for measuring the plurality of times the hydraulic pressures during the forward movement of the plunger tip.

7. The method as claimed in claim 2, wherein the proper hydraulic pressure is determined by the steps of:

injecting a molten metal into the die for producing a trial castings while monitoring a hydraulic pressure in the injection cylinder;

determining the monitored hydraulic pressure as the proper hydraulic pressure if the trial castings do not have deficiency.

* * * * *